US007200198B2

(12) United States Patent
Wieland et al.

(10) Patent No.: US 7,200,198 B2
(45) Date of Patent: Apr. 3, 2007

(54) RECIRCULATING TARGET AND METHOD FOR PRODUCING RADIONUCLIDE

(75) Inventors: Bruce W. Wieland, Chapel Hill, NC (US); Bruce C. Wright, Davenport, IA (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 10/441,437

(22) Filed: May 20, 2003

(65) Prior Publication Data

US 2004/0013219 A1 Jan. 22, 2004

Related U.S. Application Data

(60) Provisional application No. 60/382,224, filed on May 21, 2002, provisional application No. 60/382,226, filed on May 21, 2002.

(51) Int. Cl.
*G21G 1/10* (2006.01)

(52) U.S. Cl. ..... 376/195; 376/194; 376/156; 250/284

(58) Field of Classification Search ..... 376/310, 376/194, 195, 156; 250/284
See application file for complete search history.

(56) References Cited

U.S. PATENT DOCUMENTS 2,113,116 A * 4/1938 McMillan ..... 415/128
3,860,457 A * 1/1975 Vourinen et al. ..... 148/614
4,752,432 A 6/1988 Bida et al.
4,913,631 A * 4/1990 Vandendorpe ..... 417/355
4,990,787 A 2/1991 Vanderheyden et al.
5,468,355 A * 11/1995 Shefer et al. ..... 204/157.2
5,586,153 A 12/1996 Alvord
5,917,874 A * 6/1999 Schlyer et al. ..... 376/194
6,130,926 A 10/2000 Amini
6,190,119 B1 2/2001 Roth et al.
6,567,492 B2 * 5/2003 Kiselev et al. ..... 376/195
2003/0007588 A1 1/2003 Kiselev et al.

OTHER PUBLICATIONS

Lindner et al., International Journal of Applied Radiation and Isotopes, 1973, vol. 24, pp. 124-126.*
Iwata et al. , Appl. Radiation. Isot., vol. 38, No. 11, pp. 979-984, 1987.*
Keinonen, et al. Appl. Radiat. Isot., vol. 37, No. 7, pp. 631-632, 1986.*
Corken Inc., Pump Catalog, Apr. 23, 1999, through www.corke.com, website accessed Nov. 15, 2004.*

(Continued)

*Primary Examiner*—Ricardo J. Palabrica
(74) *Attorney, Agent, or Firm*—The Eclipse Group LLP; David P. Gloekler

(57) ABSTRACT

An apparatus for producing a radionuclide includes a target chamber, a particle beam source operatively aligned with the target chamber, and a regenerative turbine pump for circulating a target fluid through the target chamber via first and second liquid transports. During bombardment of the target liquid in the target chamber by the particle beam source, the target liquid is prevented from reaching vaporization due to the elevated pressure within the target chamber and/or the rapid flow rate through the target chamber. A cooling system can be provided to circulate coolant to the first and second liquid transport conduits, the target chamber and the pump to ensure that the target liquid is cooled upon recirculation back into the target chamber.

40 Claims, 3 Drawing Sheets

OTHER PUBLICATIONS

FMI Pump Catalog, Mar. 2, 2000, through www.fmipump.com, website accessed Nov. 5, 2004.*

Shaeffer, et al., "Design of a F-18 Production System at ORNL 86-Inch Cyclotron," ORNL/MIT-258, Oct. 19, 1977.*

Chu et al., "Design of a Fluorine-18 Production System at ORNL Cyclotron Facility, Part 2," ORNL/MIT-262, Nov. 28, 1977.*

Wright, "Regenerative Turbine Pumps: Unsung Heroes For Volatile Fluids", Chemical Engineering, p. 116-122 (Apr. 1999).

Proceedings of the 3rd Workshop on Targetry and Target Chemistry; Need, et al.; Successful Production of F-18 Fluorodeoxyglucose Using F-18 Ion Produced in a Nickel-Plated Copper Target; Jun. 19-23, 1989; pp. 66.

Iwata, et al.; [$^{18}$F]Fluoride Production with a Circulating [$^{18}$O]Water Target; 1987; vol. 38, No. 11, pp. 979-984.

Keinonen, et al.; Effective Small-Volume [$^{18}$O]Water Target for the Production of [$^{18}$F]Fluoride; 1986; vol. 37, No. 7, pp. 631-632.

Lindner, et al.; Technical Notes; A Dynamic "Loop"-Target for the In-Cyclotron Production of $^{18}$F by the $^{10}$O(a,d) $^{18}$F Reaction on Water; 1973; pp. 124-126.

Sixth International Symposium on Radiopharmaceutical Chemistry; Ruth, et al.; A Report on the Heidelberg Targetry Workshop; Paper 160; Jun. 29-Jul. 3, 1986; pp. 368-369.

Proceedings of the First Workshop on Targetry and Target Chemistry; Wieland; A Negative Ion Cyclotron using 11 MeV Protons for the Production of Radionuclides for Clinical Positron Tomography; Oct. 4-7, 1985; pp. 119-125.

Proceedings of the 3rd Workshop on Targetry and Target Chemistry; Wieland, et al.; Current Status of CTI Target Systems for the Production of PET Radiochemicals; Jun. 19-23, 1989; pp. 34-48.

Proceedings of the 2nd Workshop on Targetry and Target Chemistry; Wieland, et al.; Cyclotron Targets for Routing Production of F-18 Fluoride and O-15 Oxygen with an 11 MeV Proton Cyclotron; Sep. 22-25, 1987; pp. 58-62.

Sixth International Symposium on Radiopharmaceutical Chemistry; Wieland, et al.; Paper 72; Design and Performance of Targets for Producing C-11, N-13, O-15 and F-18 with 11 MeV Protons; Jun. 29-Jul. 3, 1986; pp. 159-161.

Sixth International Symposium on Radiopharmaceutical Chemistry; Wieland, et al.; Paper 78; Efficient Small-vol. O-18 Water Targets for Producing F-18 Fluoride with Low Energy Protons; Jun. 29-Jul. 3, 1986; pp. 177-179.

Sixth International Symposium on Radiopharmaceutical Chemistry; Wieland, et al.; Paper 82; Efficient, Economical Production of Oxygen-15 Labeled Tracers with Low Energy Protons; Jun. 29-Jul. 3, 1986, pp. 186-187.

Wieland, et al.; The Journal of Nuclear Medicine; Large-Scale Production and Recovery of Aqueous [F-18]-Fluoride Using Proton Bombardment of a Small-vol. [O-18]-Water Target; May 1983, vol. 24, No. 5; pp. 122.

Targetry '91 Proceedings of the IVth International workshop on Targetry and Target Chemistry; Wieland, et al.; New Liquid Target Systems for the Production of [Fluorine-18] Fluoride Ion and [Nitrogen-13] Ammonium Ion with 11 MeV Protons; Aug. 1992.

Proceedings of the Ninth International Workshop on Targetry and Target Chemistry; Wieland, et al.; Regenerative Turbine Pump Recirculating Water Target for Producing F-18-Fluoride Ion with Several kW Proton Beams; May 23-25, 2002; pp. 21-22.

Proceedings of the Ninth International Workshop on Targetry and Target Chemistry; Wieland, et al.; Self-Regulating Thermosyphon Water Target for Production of F-18-Fluoride at Proton Beam Power of One kW and Beyond; May 23-25, 2002; pp. 19-20.

Proceedings of the Fifth International Workshop on Targetry and Target Chemistry; Wieland, et al.; Utilization of the CS-30 Cyclotron at the Duke University medical Center; Sep. 19-23, 1993; pp. 359.

10th Workshop on Targetry and Target Chemistry; Abstracts; Wieland, et al.; B08: Thermosyphon Batch and regenerative Turbine Recirculating $^{18}$O(p,n) $^{18}$F Water Targets for Operation at High Beam Power; Aug. 13-15, 2004; pp. 26.

* cited by examiner

RECIRCULATING TARGET AND METHOD FOR PRODUCING RADIONUCLIDE

RELATED APPLICATIONS

This application claims the benefit of U.S. Provisional Patent Application Ser. Nos. 60/382,224 and 60/382,226, both filed May 21, 2002; the disclosures of which are incorporated herein by reference in their entireties.

TECHNICAL FIELD

The present invention relates generally to radionuclide production. More specifically, the invention relates to apparatus and methods for producing a radionuclide such as F-18 by circulating a target fluid through a beam strike target.

BACKGROUND ART

Radionuclides such as F-18, N-13, O-15, and C-11 can be produced by a variety of techniques and for a variety of purposes. An increasingly important radionuclide is the F-18 ($^{18}F^-$) ion, which has a half-life of 109.8 minutes. F-18 is typically produced by operating a cyclotron to proton-bombard stable O-18 enriched water ($H_2{}^{18}O$), according to the nuclear reaction $^{18}O(p,n)^{18}F$. After bombardment, the F-18 can be recovered from the water. For at least the past two decades, F-18 has been produced for use in the chemical synthesis of the radiopharmaceutical fluorodeoxyglucose (2-fluoro-2-deoxy-D-glucose, or FDG), a radioactive sugar. FDG is used in positron emission tomography (PET) scanning. PET is utilized in nuclear medicine as a metabolic imaging modality employed to diagnose, stage, and restage several cancer types. These cancer types include those for which the Medicare program currently provides reimbursement for treatment thereof, such as lung (non-small cell/SPN), colorectal, melanoma, lymphoma, head and neck (excluding brain and thyroid), esophageal, and breast malignancies. When FDG is administered to a patient, typically by intravenous means, the F-18 label decays through the emission of positrons. The positrons collide with electrons and are annihilated via matter-antimatter interaction to produce gamma rays. A PET scanning device can detect these gamma rays and generate a diagnostically viable image useful for planning surgery, chemotherapy, or radiotherapy treatment.

It is estimated that the cost to provide a typical FDG dose is about 30% of the cost to perform a PET scan, and the cost to produce F-18 is about 66% of the cost to provide the FDG dose derived therefrom. Thus, according to this estimate, the cyclotron operation represents about 20% of the cost of the PET scan. If the cost of F-18 could be lowered by a factor of two, the cost of PET scans would be reduced by 10%. Considering that about 350,000 PET scans are performed per year, this cost reduction could potentially result in annual savings of tens of millions of dollars. Thus, any improvement in F-18 production techniques that results in greater efficiency or otherwise lowers costs is highly desirable and the subject of ongoing research efforts.

At the present time, about half of the accelerators such as cyclotrons employed in the production of F-18 are located at commercial distribution centers, and the other half are located in hospitals. The full production potential of these accelerators is not realized, at least in part because current target system technology cannot dissipate the heat that would be produced were the full available beam current to be used. About one of every 2,000 protons stopping in the target water produces the desired nuclear reaction, and the rest of the protons simply deposit heat. It is this heat that limits the amount of radioactive product that can be produced in a given amount of time. State-of-the-art target water volumes are typically about 1–3 $cm^3$, and can typically handle up to about 500 W of beam power. In a few cases, up to 800 W of beam power have been attained. Commercially available cyclotrons capable of providing 10–20 MeV proton beam energy, are actually capable of delivering two or three times the beam power that their respective conventional targets are able to safely dissipate. Future cyclotrons may be capable of four times the power of current machines. It is proposed herein that, in comparison to conventional targets, if target system technology could be developed so as to tolerate increased beam power by a factor of ten to fifteen, the production of F-18 could be increased by up to an order of magnitude or more, and the above-estimated cost savings would be magnified.

In conventional batch boiling water target systems, a target volume includes a metal window on its front side in alignment with a proton beam source, and typically is filled with target water from the top thereof. The beam power applied to such targets is limited by the fact that above a critical beam power limit, boiling in the target volume will cause a large reduction in density, due to the appearance of a large number of vapor bubbles, which reduces the effective length of the target chamber thus moving the region of highest proton absorption into the chamber's rear wall. As a result, the target structure will receive the higher levels of particles instead of the target fluid, the target structure will be heated and not all of the target fluid will provide radioactive product. To avoid this consequence, it is proposed herein according to at least one embodiment to move the fluid out from the particle beam, at or below the point of vaporization, and conduct the fluid to a heat exchanger to extract the unwanted heat. In this manner, the only limit to the beam power allowed to impinge on the fluid would be the rate of fluid flow through the beam chamber and the ability of the heat exchanger to extract the unwanted entropy.

An opposite approach to reducing the cost of F-18 production is to use a low-energy (8 MeV), high current (100–150 mA) proton beam, as disclosed in U.S. Pat. No. 5,917,874. A cooled target volume is connected to a top conduit and a bottom conduit. A front side of the target is defined by a thin (6 μm) foil window aligned with the proton beam generated by a cyclotron. The window is supported by a perforated grid for protection against the high pressure and heat resulting from the proton beam. The target volume is sized to enable its entire contents to be irradiated. A sample of O-18 enriched water to be irradiated is injected into the target volume through the top conduit. The resulting F-18 is discharged through the bottom conduit by supplying helium through the top conduit. Such target systems as disclosed in U.S. Pat. No. 5,917,874, deliberately designed for use in conjunction with a low-power beam source, cannot take advantage of the full power available from commercially available high-energy beam sources.

As an alternative approach to the use of batch or static targets in which the target material remains in the target throughout the irradiation step, a recirculating target can be used in which the target liquid carrying the target material is circulated through the target, through a loop, and back into the target. A recirculating target is disclosed in U.S. Patent Application Pub. No. 2003/0007588. The purpose of this design is to remove F-18 continuously by slowly circulating the target fluid through an in-line trap. This avoids contaminating the irradiated fluid by not recovering the fluid in a batch via plastic tubing. In this disclosure, the target system employs a single-piston pump set to a flow rate of 5 ml/min. The liquid outputted from the target is cooled by running it through a coil that is suspended in ambient air, resulting in only a minor amount of heat removal. The cyclotron provided with this system was rated at 16.5 MeV and 75 μA, meaning that the beam power potentially available was about 1.23 kW. However, in practice the system was operated at only about 0.64 kW. It is believed that this system would not be suitable for beam powers in the range of about 1.5 kW or greater, as the single-piston pump and coil would not prevent the target liquid from boiling above about 0.64 kW.

It would therefore be advantageous to provide a recirculative target device and associated radionuclide production apparatus and method that are compatible with the full range of beam power commercially available currently and in the future, and that are characterized by improved efficiencies, performance and radionuclide yield.

SUMMARY OF THE INVENTION

According to one embodiment, an apparatus for producing a radionuclide comprises a target chamber, a particle beam source operatively aligned with the target chamber, and a regenerative turbine pump. The target chamber comprises a target inlet port and a target outlet port. The pump comprises a pump inlet port fluidly communicating with the target outlet port, and a pump outlet port fluidly communicating with the target inlet port.

According to another embodiment, an apparatus for producing a radionuclide comprises a target chamber, a particle beam source, and a pump for circulating target fluid through the target chamber at a flow rate sufficient to prevent vaporization in the target chamber. The target chamber comprises a target inlet port and a target outlet port. The particle beam source is operatively aligned with the target chamber for bombarding target fluid therein with a particle beam at a beam power of approximately 1.0 kW or greater. The pump comprises a pump inlet port fluidly communicating with the target outlet port, and a pump outlet port fluidly communicating with the target inlet port.

According to yet another embodiment, an apparatus for producing a radionuclide comprises a target chamber, a particle beam source operatively aligned with the target chamber, a pump, and first and second liquid transport conduits. The target chamber comprises a target inlet port and a target outlet port. The pump comprises a pump inlet port and a pump outlet port. The first liquid transport conduit is fluidly interposed between the pump outlet port and the target inlet port. The second liquid transport conduit is fluidly interposed between the pump inlet port and the target outlet port.

According to an additional embodiment, a method is provided for producing a radionuclide according to the following steps. A target liquid carrying a target material is circulated through a target chamber by operating a pump. The pump fluidly communicates a target inlet port and a target outlet port of the target chamber. The pump operates at a flow rate sufficient to prevent vaporization of the target liquid in the target chamber. At least a portion of the liquid medium is bombarded with a particle beam aligned with the target chamber, thereby causing the target material to react to form a radionuclide.

It is therefore an object to provide an apparatus and method for producing a radionuclide.

An object having been stated hereinabove, and which is addressed in whole or in part by the present disclosure, other objects will become evident as the description proceeds when taken in connection with the accompanying drawings as best described hereinbelow.

DETAILED DESCRIPTION OF THE INVENTION

As used herein, the term "target material" means any suitable material with which a target fluid can be enriched to enable transport of the target material, and which, when irradiated by a particle beam, reacts to produce a desired radionuclide. One non-limiting example of a target material is $^{18}O$ (oxygen-18 or O-18), which can be carried in a target fluid such as water ($H_2{}^{18}O$). When O-18 is irradiated by a suitable particle beam such as a proton beam, O-18 reacts to produce the radionuclide $^{18}F$ (fluorine-18 or F-18) according to the nuclear reaction O-18(P,N)F-18 or, in equivalent notation, $^{18}O(p,n)^{18}F$.

As used herein, the term "target fluid" generally means any suitable flowable medium that can be enriched by, or otherwise be capable of transporting, a target material or a radionuclide. One non-limiting example of a target fluid is water.

As used herein, the term "fluid" generally means any flowable medium such as liquid, gas, vapor, supercritical fluid, or combinations thereof.

As used herein, the term "liquid" can include a liquid medium in which a gas is dissolved and/or a bubble is present.

As used herein, the term "vapor" generally means any fluid that can move and expand without restriction except for a physical boundary such as a surface or wall, and thus can include a gas phase, a gas phase in combination with a liquid phase such as a droplet (e.g., steam), supercritical fluid, or the like.

Figure 1:
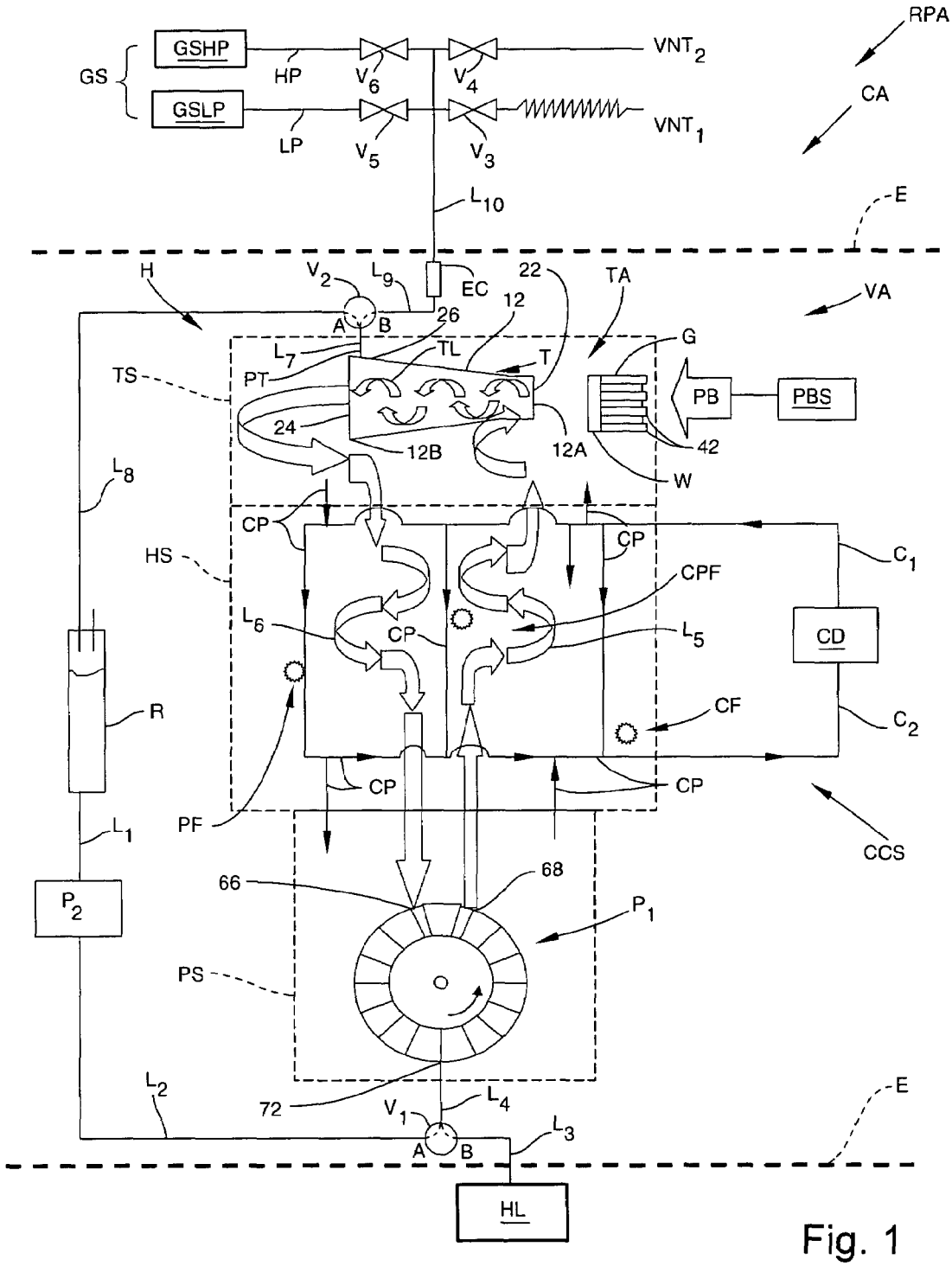
FIG. 1 is a schematic view of a radionuclide production apparatus provided in accordance with an embodiment disclosed herein.

Referring now to FIG. 1, a radionuclide production apparatus or system, generally designated RPA, and associated fluid circuitry and other components are schematically illustrated according to an exemplary embodiment. Radionuclide production apparatus RPA generally comprises a target section TS, a heat exchanging section HS, and a pump section PS. Target section TS, heat exchanging section HS, and pump section PS are generally enclosed by a housing, generally designated H, that can comprise one or more structures suitable for circulating a coolant to various components within housing H. In some embodiments, housing H integrates target section TS, heat exchanging section HS, and pump section PS together to optimize heat transfer and minimize the total fluid volume of the recirculation loop described hereinbelow.

Target section TS includes a target device or assembly, generally designated TA, that comprises a target body 12. Target body 12 in one non-limiting example is constructed from silver. Other suitable non-limiting examples of materials for target body 12 include nickel, titanium, copper, gold, platinum, tantalum, and niobium. Target body 12 defines or has formed in its structure a target chamber, generally designated T. Target body 12 further includes a front side 12A (beam input side); a back side 12B axially spaced from front side 12A; a target inlet port 22 fluidly communicating with target chamber T and disposed at or near front side 12A; a target outlet port 24 fluidly communicating with target chamber T and disposed at or near back side 12B; and a target gas port 26 for alternately pressurizing and depressurizing target chamber T. As described in more detail hereinbelow, target chamber T is designed to contain a suitable target liquid TL and enable a suitable target material carried by target liquid TL to be irradiated and thereby converted to a desired radionuclide. Target liquid TL is conducted through target chamber T from target inlet port 22 to target outlet port 24 in a preferred direction that impinges the coolest fluid on target window W rather than the hottest fluid.

A particle beam source PBS of any suitable design is provided in operational alignment with front side 12A of target body 12 for directing a particle beam PB into target chamber T. The particular type of particle means source PBS employed in conjunction with the embodiments disclosed herein will depend on a number of factors, such as the beam power contemplated and the type of radionuclide to be produced. For example, to produce the $^{18}F^{-}$ ion according to the nuclear reaction $^{18}O(p,n)^{18}F$, a proton beam source is particularly advantageous. Generally, for a beam power ranging up to approximately 1.5 kW (for example, a 100-μA current of protons driven at an energy of 15 MeV), a cyclotron or linear accelerator (LINAC) is typically used for the proton beam source. For a beam power typically ranging from approximately 1.5 kW to 15.0 kW (for example, 0.1–1.0 mA of 15 MeV protons), a cyclotron or LINAC adapted for higher power is typically used for the proton beam source. For the embodiments of radionuclide production apparatus RPA disclosed herein, a cyclotron or LINAC operating in the range approximately 1.0 kW or greater, and advantageously approximately 1.5 kW or greater and more particularly approximately 1.5 kW to 15.0 kW, is recommended for use as particle beam source PBS.

Target assembly TA further comprises a target window W interposed between particle beam source PBS and front side 12A of target body 12. Target window W can be constructed from any material suitable for transmitting a particle beam PB while minimizing loss of beam energy. A non-limiting example is a metal alloy such as the commercially available HAVAR® alloy, although other metals such as titanium, tantalum, tungsten, gold, and alloys thereof could be employed. Another purpose of target window W is to demarcate and maintain the pressurized environment within target chamber T and the vacuum environment through which particle beam PB is introduced to target chamber T, as understood by persons skilled in the art. The thickness of target window W is preferably quite small so as not to degrade beam energy, and thus can range, for example, between approximately 0.3 and 30 μm. In one exemplary embodiment, the thickness of target window W is approximately 25 μm.

In one advantageous embodiment, a window grid G is mounted at or proximal to target window W. Hence, in this embodiment, particle beam PB provided by particle beam source PBS is generally aligned with window grid G, target window W and front side 12A of target chamber T. Window grid G is useful in embodiments where target window W has a small thickness and therefore is subject to possible buckling or rupture in response to fluid pressure developed within target chamber T. Window grid G can have any design suitable for adding structural strength to target window W and thus preventing structural failure of target window W. In one embodiment, window grid G is a grid of thin-walled tubular structures adjoined in a pattern so as to afford structural strength while not appreciably interfering with the path of particle beam PB. In one advantageous embodiment, window grid G can comprise a plurality of hexagonal or honeycomb-shaped tubes 42. In one embodiment, the depth of window grid G along the axial direction of beam travel can range from approximately 1 to approximately 4 mm, and the width between the flats of each hexagonal tube 42 can range from approximately 1 to approximately 4 mm. An example of a hexagonal window grid G is disclosed in a co-pending, commonly assigned U.S. Patent Application entitled BATCH TARGET AND METHOD FOR PRODUCING RADIONUCLIDE, filed May 20, 2003. In other embodiments, additional strength is not needed for target window W and thus window grid G is not used.

In one advantageous but non-limiting embodiment, target chamber T is tapered such that its cross-section (e.g., diameter) increases from its front side 12A to back side 12B, with the diameter of its front side 12A ranging from approximately 0.5 to approximately 2.0 cm and the diameter of its back side 12B ranging from approximately 0.7 to approximately 3.0 cm. In one exemplary embodiment, the internal volume provided by target chamber T can range from approximately 0.1 to approximately 8.0 $cm^3$. In one exemplary embodiment, the depth of target chamber T from front side 12A to back side 12B can range from approximately 0.2 to 1.0 cm. The tapering profile and relatively small internal volume of target chamber T assist in synthesizing a desired radionuclide from target liquid TL by accommodating multiple scattering of particle beam PB. It is desirable to have the smallest volume possible for target chamber T in some embodiments, consistent with using all of particle beam PB to synthesize the maximum desired radionuclide from target liquid TL, in order to minimize the transit time of target liquid TL and permit the maximum beam power to be used without target liquid TL reaching its vaporization temperature. In other embodiments, the cross-section of target chamber T is uniform (i.e., cylindrical).

Heat exchanging section HS in one advantageous embodiment cools target liquid TL both prior to introduction into target chamber T and after discharge therefrom. For this purpose, first and second target liquid transport conduits $L_5$ and $L_6$, respectively, are disposed within heat exchanging section HS. In one embodiment, first and second target liquid transport conduits $L_5$ and $L_6$ carry target liquid TL to and from pump section PS along tortuous paths to maximize heat transfer, as schematically depicted in FIG. 1. Each of first and second target liquid transport conduits $L_5$ and $L_6$ can comprise one or more interconnected conduits or sections of conduits. In advantageous embodiments, the portions of first and second target liquid transport conduits $L_5$ and $L_6$ within heat exchanging section HS should provide tortuous paths, and thus can be serpentine, helical, or otherwise have several directional changes to improve heat transfer as appreciated by persons skilled in the art. As further appreciated by persons skilled in the art, additional means for maximizing heat transfer could be provided, such as cooling fins (not shown) disposed on the outside or inside of first and second target liquid transport conduits $L_5$ and $L_6$.

As further shown in FIG. 1, radionuclide production apparatus RPA includes a coolant circulation device or system, generally designated CCS, for transporting any suitable heat transfer medium such as water through various structural sections of target section TS, heat exchanging section HS, and pump section PS. A primary purpose of coolant circulation system CCS is to enable heat energy added to target liquid TL in target chamber T via particle beam PB to be removed from target liquid TL via the circulating coolant rapidly enough to prevent vaporization, and to cool down bombarded target liquid TL prior to its recirculation back into target chamber T. Coolant circulation system CCS can have any design suitable for positioning one or more coolant conduits, and thus the coolant moving therethrough, in thermal contact with various structures of target section TS, heat exchanging section HS, and pump section PS. In FIG. 1, the coolant conduits are generally represented by a main coolant inlet line $C_1$, a main coolant outlet line $C_2$ and various internal coolant passages CP running through target section TS, heat exchanging section HS, and pump section PS. The directions of coolant flow are generally represented by the various arrows illustrated with internal coolant passages CP. Coolant circulation system CCS fluidly communicates via main coolant inlet line $C_1$ and main coolant outlet line $C_2$ with a cooling device or system CD of any suitable design (including, for example, a motor-powered pump, heat exchanger, condenser, evaporator, and the like). Cooling systems based on the circulation of a heat transfer medium as the working fluid are well-known to persons skilled in the art, and thus cooling device CD need not be further described herein. In one embodiment, the cooling system typically provided with particle beam source PBS can serve or be adapted for use as cooling device CD for economical reasons.

It can be seen in FIG. 1 from the various lines and arrows depicting the coolant conduits and flow paths that the coolant flows from cooling device CD to housing H of radionuclide production apparatus RPA, circulates through target section TS, heat exchanging section HS, and pump section PS in thermal contact with the various components therein, and then returns to cooling device CD. Internal coolant passages CP can be provided in any suitable configuration designed to optimize heat transfer at the various points within target section TS, heat exchanging section HS, and pump section PS. In one advantageous embodiment, the system of internal coolant passages CP within heat exchanging section HS includes a parallel flow region generally designated PF, a counterflow region generally designated CF, and a compound flow region generally designated CPF. In parallel flow region PF, the coolant is primarily in thermal contact with second target liquid transport conduit $L_6$ and generally flows in the same resultant direction, i.e., from target section TS toward pump section PS. The parallel flow in this region is advantageous in that bombarded target liquid TL discharged from target chamber T at a relatively high temperature—for which the greatest amount of heat transfer is needed—quickly comes into contact with the relatively low-temperature coolant supplied from main coolant inlet line $C_1$. The resulting large temperature gradient results in an excellent rate of heat transfer in parallel flow region PF. In counterflow region CF, the coolant is primarily in thermal contact with first target liquid transport conduit $L_5$ and generally flows in a resultant direction opposite to that of first target liquid transport conduit $L_5$. That is, coolant generally flows from target section TS toward pump section PS in counterflow region CF, while first target liquid transport conduit $L_5$ carries liquid from pump section PS to target section TS. In compound flow region CPF, coolant circulates between first and second liquid transport conduits $L_5$ and $L_6$, is in thermal contact with both first and second liquid transport conduits $L_5$ and $L_6$, and generally includes a flow path counter to first liquid transport conduit $L_5$ and parallel with second liquid transport conduit $L_6$.

Pump section PS includes any liquid moving means characterized by having a low internal pump volume, a high discharge flow rate, and a high discharge pressure, as well as the ability to pump potentially gassy target liquid TL without any structural damage resulting from cavitation within the liquid moving means. Hence, the liquid moving means should be suitable for recirculating target liquid TL through target chamber T with such a short transit time and high pressure that target liquid TL does not reach its vaporization point before exiting target chamber T. Moreover, substantially all of the beam heat should be removed from target liquid TL before target liquid TL is returned to the liquid moving means from target chamber T. For these purposes, advantageous embodiments provide a regenerative turbine pump $P_1$ in pump section PS as the liquid moving means.

Figure 2:
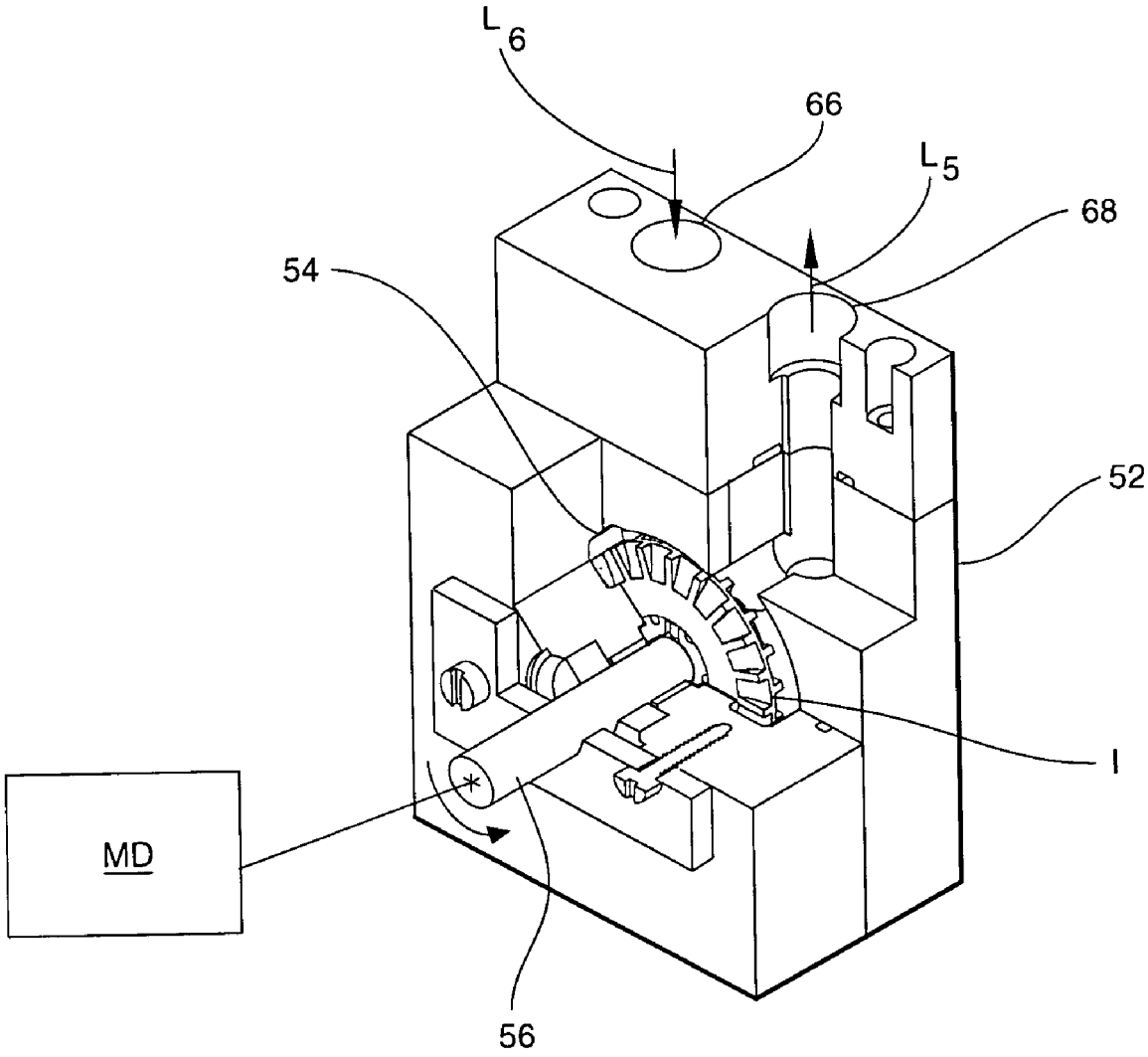
FIG. 2 is a partially cutaway perspective view of a regenerative turbine pump provided with the radionuclide production apparatus of FIG. 1.
Figure 3:
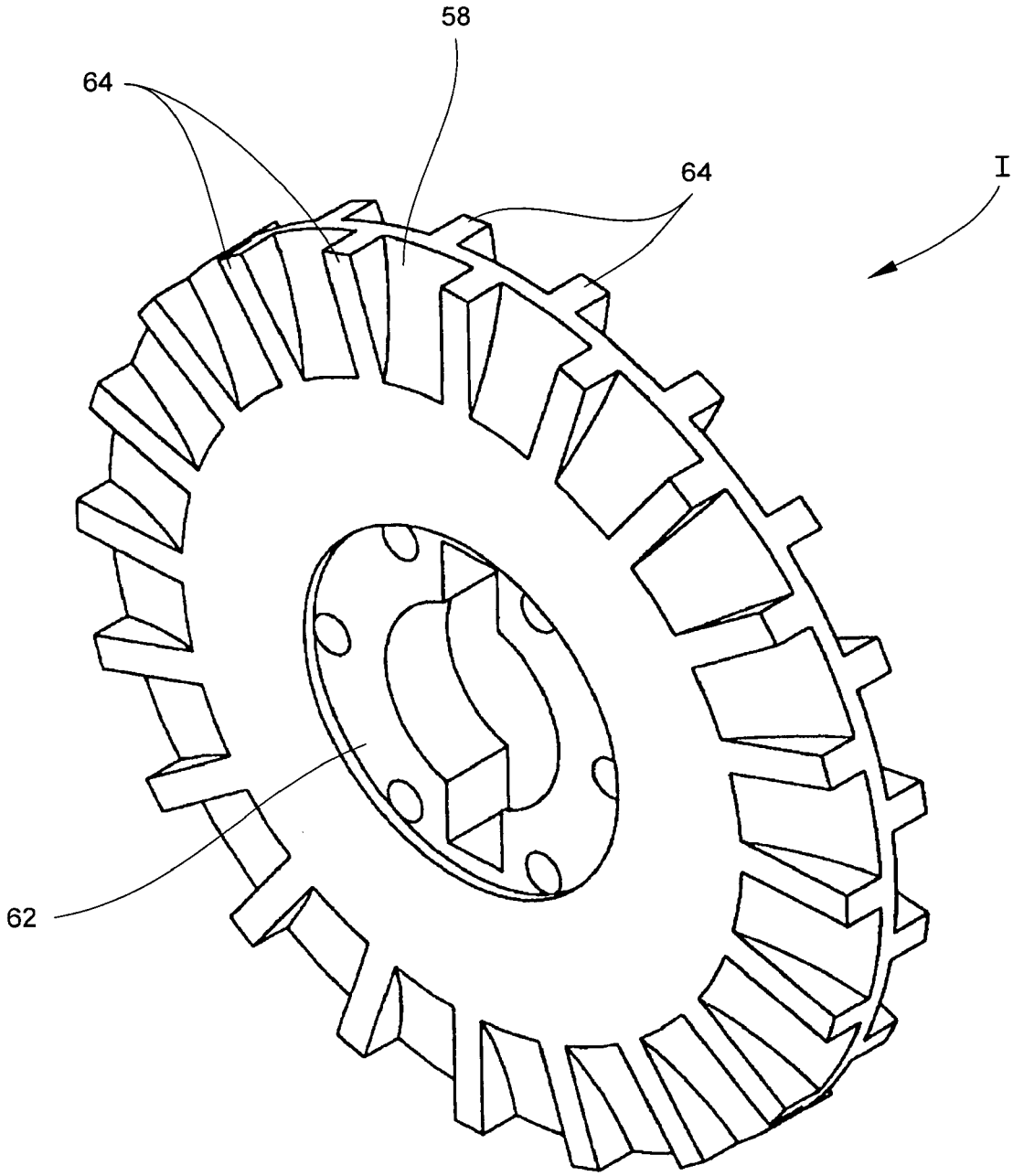
FIG. 3 is a perspective view of an impeller provided with the regenerative turbine pump of FIG. 2.

Referring to FIGS. 2 and 3, regenerative turbine pump $P_1$ includes a pump housing 52 defining an internal pump chamber 54 in which an impeller I rotates with a pump shaft 56 to which impeller I is coaxially mounted. In one advantageous embodiment, pump housing 52 is constructed from silver. Other non-limiting examples of suitable materials for pump housing 52 include nickel-plated copper, titanium, stainless steel, boron bearing stainless steel alloys and other combinations of alloys that bear significant anti-galling characteristics as appreciated by persons skilled in the art. In one advantageous embodiment, impeller I is constructed from titanium. Other non-limiting examples of suitable materials for impeller I include stainless steel and various steel alloys.

As shown in FIG. 3, impeller I has a fluted design in which a web 58 extends radially outwardly from a hub 62 and a plurality of impeller vanes or blades 64 are circumferentially spaced around web 58 at the periphery of impeller 1. As shown in FIG. 2, pump shaft 56 and thus impeller I are driven by any suitable motor drive MD and associated coupling and transmission components as appreciated by persons skilled in the art. Motor drive MD can include any suitable motor such as an electric motor or magnetically coupled motor. Pump housing 52 includes a pump suction or inlet port 66 and a pump discharge or outlet port 68, both fluidly communicating with internal pump chamber 54. As shown in FIG. 1, first target liquid transport conduit $L_5$ is interconnected between pump outlet port 68 and target inlet port 22. Second target liquid transport conduit $L_6$ is interconnected between pump inlet port 66 and target outlet port 24. Accordingly, during operation of radionuclide production apparatus RPA, a recirculation loop for target liquid TL is defined by regenerative turbine pump $P_1$, first target liquid transport conduit $L_5$, target chamber T, and second target liquid transport conduit $L_6$. Regenerative turbine pump $P_1$ further comprises a liquid transfer port 72 (FIG. 1) for alternately supplying target liquid TL enriched with a suitable target material to the system for processing, or delivering processed target liquid TL containing the desired radionuclides from the system.

By way of example, the internal pump volume (i.e., within internal pump chamber 54 of regenerative turbine pump $P_1$) can range from approximately 1 to 5 $cm^3$. Certain embodiments of regenerative turbine pump $P_1$ can include, but are not limited to, one or more of the following characteristics: the internal pump volume is approximately 2 $cm^3$, the fluid discharge pressure at or near pump outlet port 68 is approximately 500 psig, the pressure rise between pump inlet port 66 and pump outlet port 68 is approximately 30 psig, fluid flow rate is approximately 2 l/min, and impeller I rotates at approximately 5,000 rpm.

In one advantageous embodiment, the use of regenerative turbine pump $P_1$ enables target water to be transported through target chamber T in less than approximately one millisecond while absorbing several kilowatts of heat from particle beam PB without reaching the vaporization point. If the vaporization point is exceeded in a small amount of target liquid TL at the end of the particle track, a minimum amount of Bragg peak vapor bubbles will be produced in target chamber T. Any surviving Bragg peak vapor bubbles will be quickly swept away and condensed.

Unlike other types of pumps including other types of turbine pumps in which liquid passes through the impeller or other moving boundary only once, target liquid TL is exposed to impeller I of regenerative turbine pump $P_1$ many times prior to being discharged from pump outlet port 68, with additional energy being imparted to target liquid TL each time it passes through impeller blades 64, thereby allowing substantially more motive force to be added. This characteristic allows for much higher pressures to be achieved in a more compact pump design. In operation, impeller I propels target liquid TL radially outwardly via centrifugal forces, and the internal surfaces of pump housing 52 defining internal pump chamber 54 conduct target liquid TL into twin vortices around impeller blades 64. A small pressure rise occurs in the vicinity of each impeller blade 64. Vortices are formed on either side of impeller blades 64, with their helix axes curved and parallel to the circumference of impeller 1. The path followed by the liquid can be explained by envisioning a coiled spring that has been stretched so that the coils no longer touch each other. By forming the stretched spring into a circle and laying it on impeller I adjacent to impeller blades 64, the progression of fluid movement from one impeller blade to another can be envisioned.

Depending on how far the conceptual spring has been stretched (i.e., the distance between coils could be large relative to the coil diameter), the pitch of one loop of the spring may span more than the distance between adjacent impeller blades 64. As the discharge pressure increases, the pitch of the loops in the helix gets smaller in a manner analogous to compressing the spring. It has been visually confirmed that as the discharge pressure increases, the helical pitch of the fluid becomes shorter. It can thus be appreciated that any vapor bubbles found in the incoming fluid, because of the inertia of the fluid in the vortex, are forced away from the metal walls defining internal pump chamber 54 of regenerative turbine pump $P_1$ into the center of the helix (i.e., spring). The pressure increase from pump inlet port 66 to pump outlet port 68 is much lower than for other types of pumps, because the pressure is building continuously around the pumping channel rather than in a single quick passage through pressurizing elements, in this case impeller blades 64. Consequently, the shock of collapsing bubbles is virtually non-existent, and any bubbles that do collapse impinge on adjacent fluid and not on the metal pump components.

Thus, regenerative turbine pump $P_1$ is exceptional in its ability to tolerate cavitation in target liquid TL received at pump inlet port 66. In target chamber T during operation, the beam energy input and F-18 conversion (heating vs. F-18 production) rate are not easily controlled, and thus the temperature of target liquid TL leaving target chamber T can easily allow vaporization to occur. The resulting vapor bubbles can easily be carried through to regenerative turbine pump $P_1$ and be present when the compression cycle begins. In other types of pumps, these vapor bubbles would collapse violently, releasing shock waves that would erode the material used in construction of the elements of the pumps that are in contact with the fluid when the collapse occurs. Moreover, regenerative turbine pump $P_1$ generally operates according to a ramped pressure curve that ensures substantially consistent flow to, through, and from target chamber T. The features of regenerative turbine pump $P_1$ just described, as well as its extremely low internal pump volume according to embodiments disclosed herein, make regenerative turbine pump $P_1$ desirable for use with radionuclide production apparatus RPA. As a general matter, the merits of regenerative turbine pumps are discussed in Wright, Bruce C., "Regenerative Turbine Pumps: Unsung Heroes For Volatile Fluids", *Chemical Engineering*, p. 116–122 (April 1999).

In one advantageous embodiment, the total volume of target water within the system integrated in housing H (FIG. 1) is approximately 10 $cm^3$ or less.

Referring again to FIG. 1, the remaining primary components of radionuclide production apparatus RPA will be described. Radionuclide production apparatus RPA further comprises an enriched target fluid supply reservoir R; an auxiliary pump $P_2$ for transporting an initial supply of target liquid TL to regenerative turbine pump $P_1$ before regenerative turbine pump $P_1$ is activated; an expansion chamber EC for accommodating thermal expansion of target liquid TL during heating by particle beam PB during operation of target chamber T; and a pressurizing gas supply source GS for pressurizing target chamber T. Radionuclide production apparatus RPA additionally comprises various vents $VNT_1$, and $VNT_2$ to atmosphere; valves $V_1$–$V_6$; and associated fluid lines $L_1$–$L_{10}$ as appropriate for the fluid circuitry or plumping needed to implement the embodiments disclosed herein. A radiation-shielding enclosure E, a portion of which is depicted schematically by bold dashed lines in FIG. 1, defines a vault area, generally designated VA, which houses the potentially radiation-emitting components of radionuclide production apparatus RPA. On the other side of enclosure E is a console area, generally designated CA, in which remaining components as well as appropriate operational control devices (not shown) are situated, and which is safe for users of radionuclide production apparatus RPA to occupy during its operation. Also external to vault area VA is a remote, downstream radionuclide collection site or "hot lab" HL, for collecting and/or processing the as-produced radionuclides into radiopharmaceutical compounds for PET or other applications.

Enriched target fluid supply reservoir R can be any structure suitable for containing a target material carried in a target medium, such as the illustrated syringe-type body. Auxiliary pump $P_2$ can be of any suitable design, such as a MICRO π-PETTER® precision dispenser available from Fluid Metering, Inc., Syosset, N.Y. Pressurizing gas supply source GS is schematically depicted as including a high-pressure gas supply source GSHP and a low-pressure gas supply source GSLP. This schematic depiction can be implemented in any suitable manner. For example, a single pressurizing gas supply source GS (for example, a tank, compressor, or the like) could be employed in conjunction with an appropriate set of valves and pressure regulators (not shown) to selectively supply high-pressure gas (e.g., 500 psig or thereabouts) in a high-pressure gas line HP or low-pressure gas (e.g., 30 psig or thereabouts) in a low-pressure gas line LP. For another example, two separate gas sources could be provided to serve as high-pressure gas supply source GSHP and a low-pressure gas supply source GSLP. The pressurizing gas can be any suitable gas that is inert to the nuclear reaction producing the desired radionuclide. Non-limiting examples of a suitable pressurizing gas include helium, argon, and nitrogen. In the exemplary embodiment illustrated in FIG. 1, valves $V_1$, and $V_2$ are three-position ball valves actuated by gear motors and are rated at 2500 psig. For each of valves $V_1$, and $V_2$, two ports A and B are alternately open or closed and the remaining port is blocked. Hence, when both ports A and B are closed, fluid flow through that particular valve $V_1$ or $V_2$ is completely blocked. Remaining valves $V_3$–$V_6$ are solenoid-actuated valves. Other types of valve devices could be substituted for any of valves $V_{1-V6}$ as appreciated by persons skilled in the art. Fluid lines $L_1$–$L_{10}$ are sized as appropriate for the target volume to be processed in target chamber T, one example being 1/32 inch I.D. or thereabouts.

The fluid circuitry or plumbing of radionuclide production apparatus RPA according to the embodiment illustrated in FIG. 1 will now be summarized. Fluid line $L_1$ interconnects target material supply reservoir R and the inlet side of auxiliary pump $P_2$ for conducting target liquid TL enriched with the target material. Fluid line $L_2$ interconnects the outlet side of auxiliary pump $P_2$ and port A of valve $V_1$ for delivering enriched target liquid TL to initially load regenerative turbine pump $P_1$, first and second liquid transport conduits $L_5$ and $L_6$ and target chamber $T_1$. Fluid line $L_3$ is a delivery line for delivering as-produced radionuclides to hot lab HL from port B of valve $V_1$. In one embodiment, delivery line $L_3$ is approximately 100 feet in length. Fluid line $L_4$ is a transfer line interconnected between valve $V_1$ and liquid transfer port 72, for alternately supplying enriched target liquid TL to the recirculating system or delivering target liquid TL carrying the as-produced radionuclides from the system. First target liquid transport conduit $L_5$ interconnects pump outlet port 68 and target inlet port 22 and enables target liquid TL to be cooled in heat exchanger section HS prior to returning to target chamber T as described above. Second target liquid transport conduit $L_6$ interconnects target outlet port 24 and pump inlet port 66, and enables target liquid TL to be cooled in heat exchanger section HS after exiting from target chamber T as described above. Fluid line $L_7$ interconnects target gas port 26 and valve $V_2$. Fluid line $L_8$ interconnects port A of valve $V_2$ and enriched target fluid supply reservoir R, and is primarily used to recirculate enriched target liquid TL back to supply reservoir R during the loading of the system and thereby sweep away bubbles in the lines. Fluid lines $L_9$ and $L_{10}$ are connected on either side of expansion chamber EC, and interconnect port B of valve $V_2$ and either gas supply source GS or vents $VNT_1$ and/or $VNT_2$ for alternately conducting pressurizing gas to valve $V_2$ or conducting vapors or gases from target chamber T to vents $VNT_1$ and/or $VNT_2$. Alternatively, a separate expansion or depressurization line (not shown) could be provided for interconnecting expansion chamber EC with vent $VNT_2$.

The operation of target assembly TA and radionuclide production apparatus RPA will now be described, with primary reference being made to FIG. 1. In preparation of radionuclide production apparatus RPA and its target assembly TA for the loading of target chamber T and subsequent beam strike, the fluidic system can be vented to atmosphere by opening valve $V_3$ and/or $V_4$ and port B of valve $V_2$. Also, a target liquid TL enriched with a desired target material is loaded into reservoir R, or a pre-loaded reservoir R is connected with fluid lines $L_1$ and $L_8$. Port A of valve $V_1$ and port A of valve $V_2$ are then opened, thereby establishing a closed loop through auxiliary pump $P_2$, valve $V_1$, regenerative turbine pump $P_1$, target chamber T, valve $V_2$, and reservoir R. Auxiliary pump $P_2$ is then activated, whereupon enriched target liquid TL is transported to target chamber T, completely filling the recirculation loop comprising regenerative turbine pump $P_1$, first target liquid transport conduit $L_5$, target chamber T, and second target liquid transport conduit $L_6$. During the charging of the recirculation loop in this manner, enriched target liquid TL is permitted to flow back through valve $V_2$ and reservoir R, ensuring that any bubbles in the closed loop are swept away. Once charged in this manner, target chamber T is effectively sealed off at the top by closing port A of valve $V_2$.

Target chamber T is then pressurized by opening valve $V_6$ and delivering a high-pressure gas via high-pressure gas line HP, fluid line $L_{10}$, expansion chamber EC, fluid line $L_9$, port B of valve $V_2$, fluid line $L_7$, and target gas port 26. A system leak check can then be performed by closing valve $V_2$ and observing a pressure transducer PT. Port A of valve $V_1$ is then closed and regenerative turbine pump $P_1$ is activated to begin circulating target liquid TL through the previously described recirculation loop through target section TS, heat exchanger section HS, and pump section PS. The pressure head applied to target gas port 26 is sufficient to prevent target liquid TL from escaping through target gas port 26, except for any thermal expansion that might occur due to beam heating of target liquid TL. Coolant circulation system CCS is also activated to begin circulating coolant as described hereinabove.

At this stage, target chamber T is ready to receive particle beam PB. Particle beam source PBS is then operated to emit a particle beam PB through window grid G and target window W in alignment with front side 12A of target body 12. Particle beam PB irradiates enriched target liquid TL in target chamber T and also transfers heat energy to target liquid TL. The energy of the particles is sufficient to drive the desired nuclear reaction within target chamber T. However, the very short transit time (e.g., approximately 1 ms or less) of target liquid TL through target chamber T and the high pressure (i.e., raising the boiling point) within target chamber T prevents target liquid TL from vaporizing, which could be detrimental for beam powers of approximately 1.5 kW or above. Moreover, the operation of coolant circulation system CCS, with its system of conduits as described hereinabove, removes heat energy from target liquid TL throughout target section TS, heat exchanging section HS, and pump section PS.

The nuclear effect of particle beam PB irradiating the enriched target fluid in target chamber T is to cause the target material in target liquid TL to be converted to a desired radionuclide material in accordance with an appropriate nuclear reaction, the exact nature of which depends on the type of target material and particle beam PB selected. Examples of target materials, target fluids, radionuclides, and nuclear reactions are provided hereinbelow. Particle beam PB is run long enough to ensure a sufficient or desired amount of radionuclide material has been produced in target chamber T, and then is shut off. A system leak check can then be performed at this time.

Once the radionuclides have been produced and particle beam source PBS is deactivated, radionuclide production apparatus RPA can be taken through pressure equalization and depressurization procedures to gently or slowly depressurize target chamber T, first and second liquid transport conduits $L_5$ and $L_6$, and regenerative turbine pump $P_1$ in preparation for delivery of the radionuclides to hot lab HL. These procedures are designed to be gentle or slow enough to prevent any pressurizing gas that is dissolved in target liquid TL from escaping the liquid-phase too rapidly and causing unwanted perturbation of target liquid TL. Port B of valve $V_2$ is left open when particle beam PB is turned off. The pressurizing gas is then bled off through expansion chamber EC and vents to atmosphere via depressurization line $L_{10}$ and restricted vent $VNT_1$. In one advantageous embodiment, depressurization line $L_{10}$ has a smaller inside diameter than the other fluid lines in the system, and is relatively long (e.g., 0.010 inch I.D., 100 feet). While port B of valve $V_2$ remains open, valve $V_3$ is closed and valve $V_4$ is opened to allow any remaining gas to vent completely to atmosphere via vent $VNT_2$.

After depressurization, port B of valve $V_1$ is opened to establish fluid communication from regenerative turbine pump $P_1$ at its liquid transfer port 72, through fluid line $L_4$, valve $V_1$, fluid line $L_3$, and an appropriate downstream site such as hot lab HL. At this point, a gravity drain into delivery line $L_3$ can be initiated. One or more pressurizing steps can then be performed to cause target liquid TL and radionuclides carried thereby to be delivered out from the system to hot lab HL for collection and/or further processing. For example, valve $V_5$ can be opened to use low-pressure gas from pressurizing gas source GS over low-pressure gas line LP for pushing target liquid TL into hot lab HL.

After delivery of the as-produced radionuclides is completed, radionuclide production apparatus RPA can be switched to a standby mode in which the fluidic system is vented to atmosphere by opening valve $V_3$ and/or valve $V_4$. At this stage, reservoir R can be replenished with an enriched target fluid or replaced with a new pre-loaded reservoir R in preparation for one or more additional production runs. Otherwise, all valves $V_1$–$V_6$ and other components of radionuclide production apparatus RPA can be shut off.

The radionuclide production method just described can be implemented to produce any radionuclide for which use of radionuclide production apparatus RPA and its recirculating and/or heat exchanging functions would be beneficial. One example is the production of the radionuclide F-18 from the target material O-18 according to the nuclear reaction O-18 (P,N)F-18. Once produced in target chamber T, the F-18 can be transported over delivery line $L_3$ to hot lab HL, where it is used to synthesize the F-18 labeled radiopharmaceutical fluorodeoxyglucose (FDG). The FDG can then be used in PET scans or other appropriate procedures according to known techniques. It will be understood, however, that radionuclide production apparatus RPA could be used to produce other desirable radionuclides. One additional example is $^{13}N$ produced from natural water according to the nuclear reaction $^{16}O(p,\alpha)^{13}N$ or, equivalently, $H_2{}^{16}O(p,\alpha)^{13}NH_4^+$.

It will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. A fluorine-18 ion ($^{18}F^-$) recirculating-target radionuclide producing apparatus, comprising:

(a) a target chamber comprising a target inlet port and a target outlet port and including oxygen-18 enriched target liquid;

(b) means for applying a proton beam to the target chamber for irradiating the oxygen-18 enriched target liquid in the target chamber at a beam power of 1.0 kW or greater;

(c) a regenerative turbine pump comprising a pump inlet port and a pump outlet port;

(d) a heat exchanging section disposed externally from the target chamber and interposed between the target chamber and the regenerative turbine pump;

(e) a first liquid transport conduit interconnecting the pump outlet port and the target inlet port; and (f) a second liquid transport conduit extending through the heat exchanging section and interconnecting the target outlet port and the pump inlet port.

2. The apparatus according to claim 1 wherein the target chamber has an internal volume, and a cross-section of the internal volume is smaller at a front side of the target chamber than at a back side thereof.

3. The apparatus according to claim 1 wherein the target chamber has an internal volume, and a cross-section of the internal volume generally tapers from a back side of the target chamber to a front side thereof.

4. The apparatus according to claim 1 wherein the target chamber has an internal volume ranging from approximately 0.5 to approximately 8.0 $cm^3$.

5. The apparatus according to claim 1 wherein the target chamber has a front side in operative alignment with the proton beam applying means and a back side axially spaced from the front side, the target inlet port is disposed closer to the front side than to the back side, and the target outlet port is disposed closer to the back side than to the front side.

6. The apparatus according to claim 1 comprising a particle-transmitting window adjacent to a front side of the target chamber, wherein the proton beam applying means is operatively aligned with the window.

7. The apparatus according to claim 6 wherein the window is constructed from a material suitable for transmitting protons.

8. The apparatus according to claim 7 wherein the window has a metal-containing composition.

9. The apparatus according to claim 1 wherein the proton beam applying means includes a proton beam source operatively aligned with the target chamber.

10. The apparatus according to claim 1 wherein the proton beam applying means comprises a cyclotron.

11. The apparatus according to claim 1 wherein the proton beam applying means comprises a linear accelerator.

12. The apparatus according to claim 1 wherein the proton beam applying means is configured to provide a beam power of approximately 1.5 kW or greater.

13. The apparatus according to claim 1 wherein the proton beam applying means is configured to provide a beam power ranging from approximately 1.5 kW to approximately 15.0 kW.

14. The apparatus according to claim 1 comprising a liquid transfer conduit fluidly communicating with the pump.

15. The apparatus according to claim 14 comprising a target liquid supply source selectively fluidly communicating with the transfer conduit.

16. The apparatus according to claim 15 wherein the target liquid supply source comprises an oxygen-18 enriched water source.

17. The apparatus according to claim 14 comprising a radionucide delivery conduit selectively fluidly communicating with the transfer conduit.

18. The apparatus according to claim 1 comprising means for circulating a coolant through the heat exchanger section and into contact with the second liquid transport conduit.

19. The apparatus according to claim 18 wherein the coolant circulating means includes a plurality of coolant passages extending through the heat exchanger section, wherein at least one of the coolant passages circulates coolant into contact with the second liquid transport conduit.

20. The apparatus according to claim 1 comprising a coolant circulation system including a plurality of coolant passages extending through the heat exchanger section.

21. The apparatus according to claim 20, further comprising a housing including the heat exchanging section and a pump section, wherein the pump is disposed in the pump section.

22. The apparatus according to claim 21 wherein at least one of the plurality of coolant passages extends through the pump section.

23. The apparatus according to claim 1 wherein the pump includes an internal pump chamber fluidly interposed between the pump inlet port and the pump outlet port, and the total volume of the internal pump chamber ranges from approximately 1 to approximately 5 $cm^3$.

24. The apparatus according to claim 1 wherein the pump comprises a pump housing constructed from a metal.

25. The apparatus according to claim 24 wherein the metal is selected from the group consisting of silver, copper, titanium, stainless steel, alloys of these, and combinations thereof.

26. The apparatus according to claim 1 wherein the pump comprises an impeller constructed from a metal.

27. The apparatus according to claim 26 wherein the metal is selected from the group consisting of titanium, stainless steel, alloys of these, and combinations thereof.

28. The apparatus according to claim 1 wherein the target chamber comprises a front side for receiving a proton beam from the proton beam applying means and a back side spaced from the front side, and the target chamber has a depth from the front side to the back side ranging from approximately 0.2 to approximately 1.0 cm.

29. The apparatus according to claim 6 wherein the window has a thickness ranging from approximately 0.3 to approximately 30 μm.

30. The apparatus according to claim 6 comprising a window grid interposed between the front side of the target chamber and a beam-outlet side of the proton beam applying means, wherein the proton beam applying means is operatively aligned with the window grid.

31. The apparatus according to claim 20 wherein the first liquid transport conduit extends through the heat exchanging section, and the heat exchanging section includes a counterflow region in which the target liquid flow in the first liquid transport conduit is directed toward the target chamber from the pump and the coolant flow in at least one of the plurality of coolant passages is directed away from the target chamber toward the pump.

32. The apparatus according to claim 23, wherein the total volume is approximately 2 $cm^3$.

33. The apparatus according to claim 1, wherein the target chamber, the pump, and the first and second liquid transport conduits define a target liquid recirculation loop, and the total volume of target liquid in the recirculation loop is approximately 10 $cm^3$ or less.

34. The apparatus according to claim 18, wherein the first liquid transport conduit extends through the heat exchanging section, and the coolant circulating means circulates the coolant into contact with the first liquid transport conduit.

35. The apparatus according to claim 20, wherein the first liquid transport conduit extends through the heat exchanging section.

36. Tbe apparatus according to claim 20, further comprising a housing including the heat exchanging section and a target section, wherein the target chamber is disposed in the target section.

37. The apparatus according to claim 36 wherein at least one of the plurality of coolant passages extends through the target section.

38. The apparatus according to claim 37 wherein the housing includes a pump section, the pump is disposed in the pump section and at least one other passage of the plurality of coolant passages extends through the pump section.

39. The apparatus according to claim 20 wherein the heat exchanging section includes a parallel-flow region in which the target liquid flow in the second liquid transport conduit and the coolant flow in at least one of the plurality of coolant passages are directed in the same direction away from the target chamber toward the pump.

40. The apparatus according to claim 39 wherein the first liquid transport conduit extends through the heat exchanging section, and the heat exchanging section includes a counterflow region in which the target liquid flow in the first liquid transport conduit is directed toward the target chamber from the pump and the coolant flow in at least one other passage of the plurality of coolant passages is directed away from the target chamber toward the pump.

* * * * *